US005226574A

United States Patent [19]

Durinzi, Jr.

[11] Patent Number: 5,226,574

[45] Date of Patent: Jul. 13, 1993

[54] PORTABLE DISPENSING CONTAINER FOR LIQUID FUEL

[76] Inventor: Armando F. Durinzi, Jr., 203 Orchard View La., Reading, Pa. 19606

[21] Appl. No.: 745,717

[22] Filed: Aug. 16, 1991

[51] Int. Cl.[5] ..... A47G 19/14

[52] U.S. Cl. ..... 222/465.1; 222/572; 239/377; 220/86.1; 220/771; 215/1 C

[58] Field of Search ..... 222/164, 166, 460, 462, 222/465.1, 478, 479, 481, 482, 566, 572, 527, 535, 538; 215/1 C, 100 A; 220/94 A, 94 B, 86.1–86.4, 905, DIG. 14; 239/377

[56] References Cited

U.S. PATENT DOCUMENTS

| | | | |
|---|---|---|---|
| 425,502 | 4/1890 | Gates . | |
| 528,565 | 11/1894 | Schiebat | 222/566 X |
| 877,322 | 1/1908 | Gebler | 222/566 |
| 1,362,186 | 12/1920 | Price . | |
| 1,736,479 | 11/1929 | Bjornson | 222/566 X |
| 1,849,950 | 5/1930 | Murdock . | |
| 2,026,839 | 1/1936 | Krause | 222/566 |
| 2,026,852 | 1/1936 | Smith | 222/566 |
| 2,078,497 | 6/1934 | Johnston | 220/1 |
| 2,633,002 | 3/1951 | Radus | 60/54.6 |
| 3,308,599 | 3/1967 | Perlowski | 53/22 |
| 3,643,690 | 2/1972 | Sarai | 220/86.2 X |
| 3,865,270 | 2/1975 | Petersson | 220/85 B |
| 3,927,797 | 12/1975 | Flider | 220/94 A X |
| 4,069,946 | 1/1978 | Flider | 222/538 X |
| 4,125,207 | 11/1978 | Ernst et al. | 222/538 X |
| 4,189,072 | 2/1980 | Conn | 222/519 |
| 4,292,846 | 10/1981 | Barnett | 73/427 |
| 4,401,241 | 8/1983 | Cruz | 222/527 |
| 4,583,668 | 4/1986 | Maynard, Jr. | 222/529 |
| 4,588,111 | 5/1986 | Hestehave | 220/86.1 X |
| 4,600,125 | 7/1986 | Maynard, Jr. | 222/81 |
| 4,640,446 | 2/1987 | Walker | 222/416 |
| 4,664,301 | 5/1987 | Hoyt | 222/567 |
| 4,781,314 | 11/1988 | Schoonover et al. | 222/465 |
| 4,804,119 | 2/1989 | Goodall | 222/465.1 X |
| 4,811,870 | 3/1989 | Bianco | 222/461 |
| 4,856,664 | 8/1989 | Gillispie et al. | 215/31 |
| 4,901,878 | 2/1990 | Humphries | 220/94 |
| 4,921,147 | 5/1990 | Poirier | 222/527 |
| 4,923,098 | 5/1990 | Schoonover et al. | 222/456.1 |
| 4,969,571 | 11/1990 | Bartz | 220/94 A |

*Primary Examiner*—Andres Kashnikow
*Assistant Examiner*—Kenneth DeRosa
*Attorney, Agent, or Firm*—Synnestvedt & Lechner

[57] ABSTRACT

An inexpensive portable gasoline container, molded integrally of plastic, has a top fill opening and a top, diagonally upwardly-extending pouring spout, preferably with handle regions molded into the container itself. The spout is slightly flexible, and in use its tip is first placed in a position in which it extends upwardly into the entrance end of a downwardly-extending inlet to an automobile gas tank. The container is then rotated substantially about the axes of the spout so that the spout extends downwardly into the tank inlet and the body of the container is higher than the inlet, whereby the gasoline will be dispensed through the spout into the gas tank.

3 Claims, 2 Drawing Sheets

FIG. 1
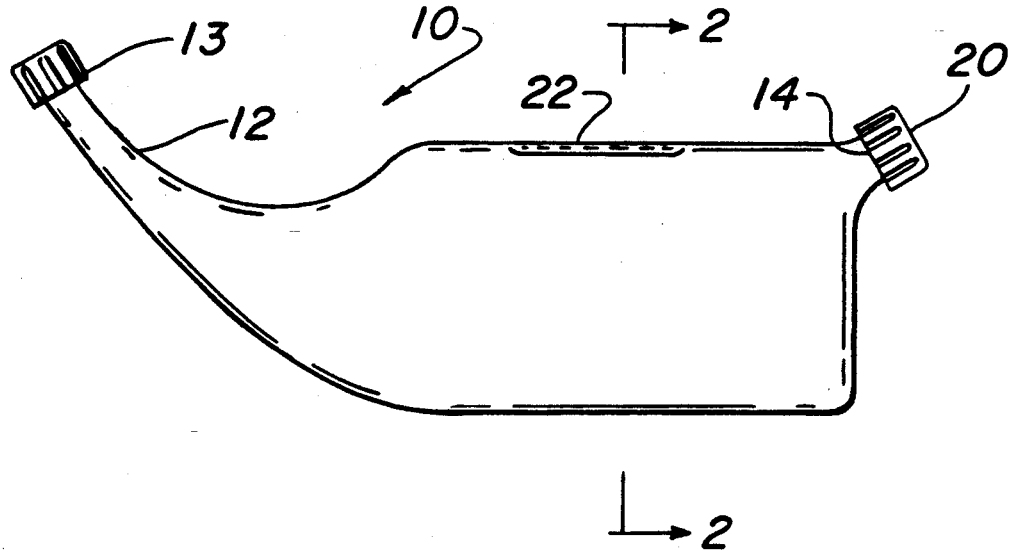
FIG. 2
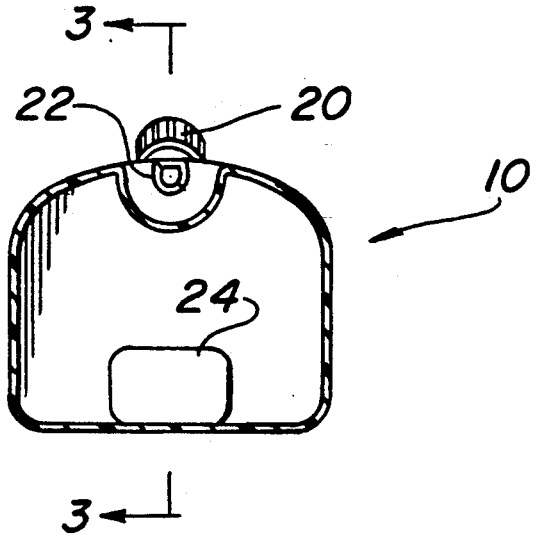
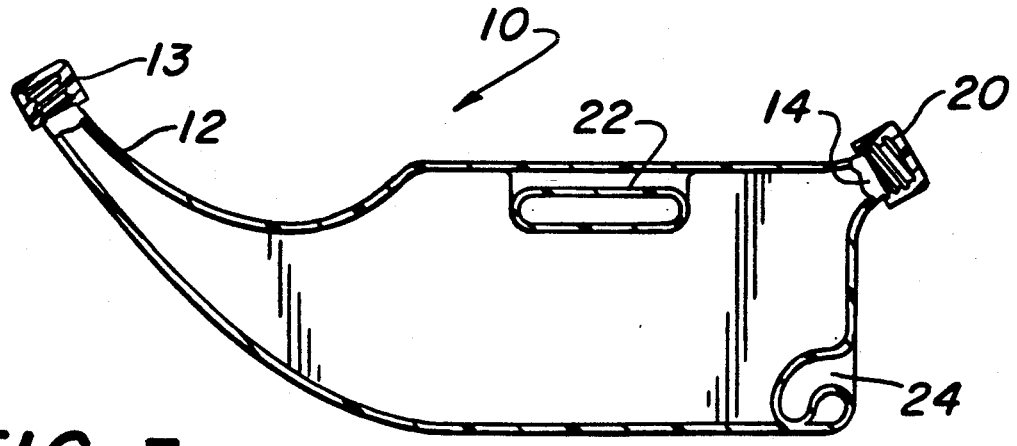
FIG. 3

FIG. 4
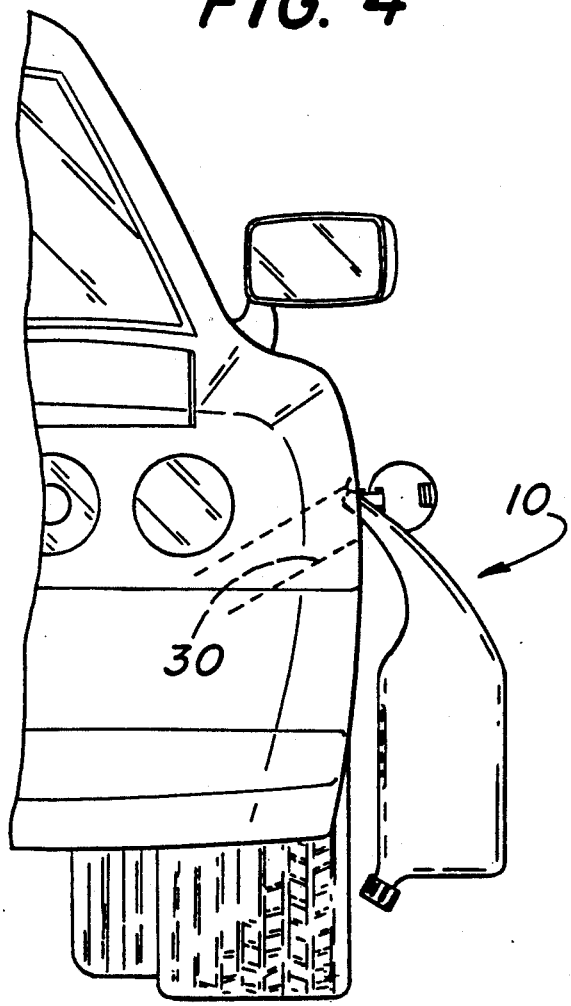
FIG. 5
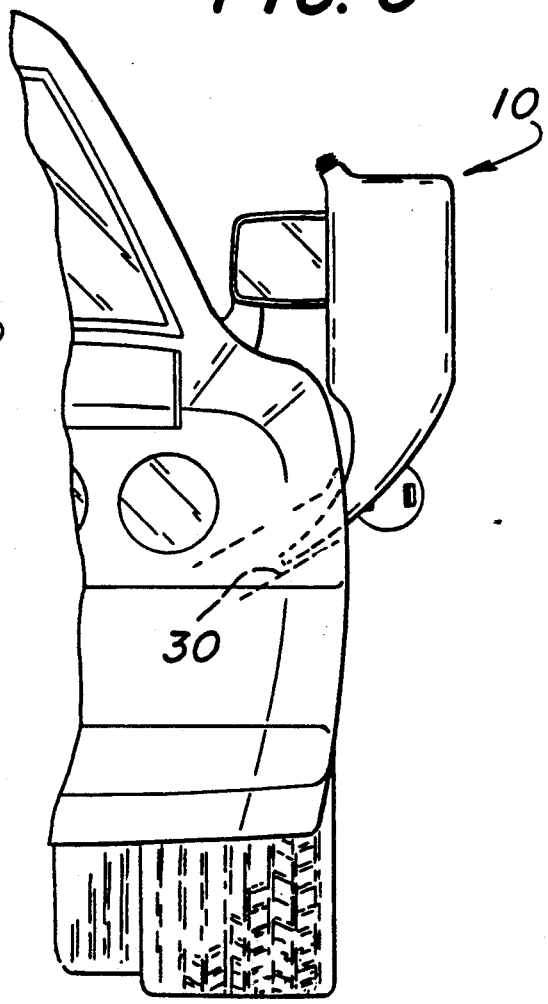
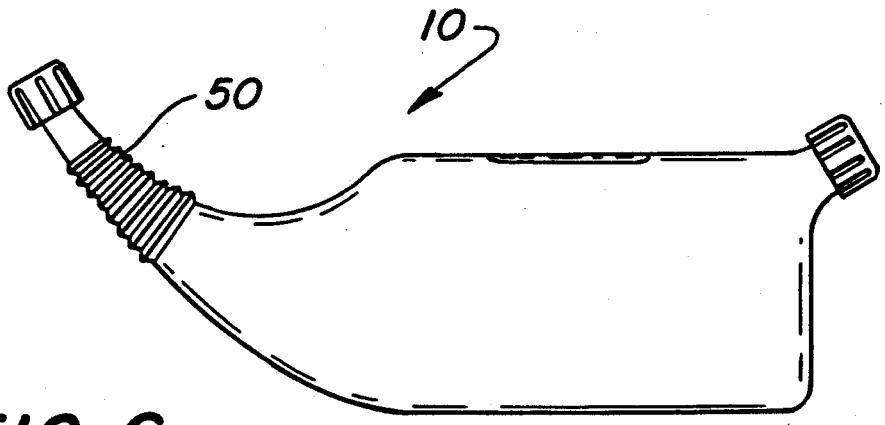
FIG. 6

PORTABLE DISPENSING CONTAINER FOR LIQUID FUEL

FIELD OF THE INVENTION

This invention relates to portable dispensing containers for liquid fuels, and particularly to small portable containers for carrying gasoline or similar liquid fuels to a vehicle for pouring into the vehicle fuel reservoir from the container.

BACKGROUND OF THE INVENTION

Various containers are known for carrying and dispensing liquid fuels. Typically they comprise a tank with a relatively large opening for pouring fuel into the tank and some sort of spout for pouring the liquid from the tank into another container, such as the fuel reservoir of an automotive vehicle. Such apparatus is particularly useful, for example, when an automobile is out of gas, and it is desired to bring emergency fuel from a gas station to the vehicle and introduce it into the gas reservoir of the vehicle.

While such apparatus has been reasonably effective for its intended purposes, it is often somewhat expensive due to the nature of its construction. It will be appreciated that in pouring gasoline into a car fuel reservoir, for example, the intake passage to the reservoir is relatively narrow, and extends generally downwardly. Since to empty the container it must be moved so that it is turned through a large elevational angle during filling, if the spout is rigid it will tend to resist such turning of the container and, in fact, make it impossible to completely invert the container so as to expel all of the fuel into the auto fuel reservoir. Accordingly, it is common to make the spout of a flexible material, such as a goose-neck type of construction, or a simple flexible hose, as examples. Goose-neck type construction is rather expensive, and while a flexible hose is inexpensive, it must be secured to the container outlet opening in a leak-proof manner, which generally means a rather expensive fitting of some sort.

The present invention is primarily concerned with providing an improved portable dispensing container for liquid fuels having a top inlet for filling the container and a top outlet spout for dispensing the fuel, which permits easy insertion of the spout into the inlet passage of a fuel reservoir and pouring of the fuel completely out of the container into the reservoir, yet is very inexpensive and simple to make.

SUMMARY OF THE INVENTION

These and other objects of the invention are achieved by the provision of a portable dispensing container for liquid fuel comprising a portable tank having a dispensing spout integral therewith and communicating with said tank near one end of the top thereof; also used is a filler opening near the opposite end of the tank through which the fuel is introduced into the container, and which is fitted with a removable closure cap. In order to carry the container conveniently, a handle is preferably provided at the top, formed integrally with the rest of the tank, and preferably another such integral handle is provided at or near the end of the bottom of the tank opposite from the end at which the dispensing nozzle is located.

The outlet spout is preferably directed at an upward angle to the horizontal which is substantially equal to the downward angle which the inlet to the gas tank of the can makes with the horizontal.

In use in accordance with the method of the invention, fuel is introduced into the container through the fuel opening, and the cap then placed tightly over the opening as by screwing it on. This is preferably done while the bottom of the tank is substantially horizontal, and preferably while it is resting on a horizontal support surface such as the ground. Next the cap 13 is removed and, the nozzle end of the container is turned upwardly, by about 90°, with the dispensing nozzle extending at an upward oblique angle so that its tip portion can readily be introduced into the opening of the inlet to the vehicle gas reservoir. The container is next rotated about an axis extending substantially along the axis of the nozzle, while permitting the nozzle to move inwardly of, and seat itself appropriately in, the fuel inlet. If there is no other appropriate venting arrangement, the cap may be then loosened slightly to permit entrance of outside air, whereby the gasoline in the container can rush downwardly and outwardly through the spout into the gas fuel inlet of the fuel reservoir, until the entire container is thereby emptied.

Preferably the spout has some degree of flexibility to aid in placing its tip within the gas intake line upon initial insertion; however, it is self-supporting and operates within its elastic limit, that is, it does not have a goose-neck type operation whereby it would remain at any angled position in which it is placed, nor is it limp so that it will fall away from its prescribed initial direction.

This configuration of container and its method of use permit the container, including its spout and recessed handles, to be made of suitable plastic material in one molding operation, hence inexpensively, so as to be substantially a throw-away item suitable for one-time use. Such a container therefore does away with the problem of providing deposits for elaborate gas containers at gas stations for use by out-of-gas motorists; the gas station may practically give the container away, or lend it with only a small deposit for its use, or none at all.

BRIEF DESCRIPTION OF THE FIGURES

These and other aspects and features of the invention will be more readily understood from a consideration of the following detailed description, taken with the accompanying drawings, in which:

FIG. 1 is a side elevational view of a container in accordance with the invention;

FIG. 2 is a sectional view taken along lines 2—2 of FIG. 1;

FIG. 3 is a sectional view taken along lines 3—3 of FIG. 2;

FIG. 4 is a fragmentary view of a portion of the rear of an automobile with the container of the invention shown upon initial insertion of the tip of the nozzle of the container into the inlet passage of the gasoline tank of the automobile;

FIG. 5 is a view taken similarly to FIG. 4, but with the container rotated 180° about the axis of the nozzle to effect pouring into the tank; and FIG. 6 is a side elevational view of another embodiment of the invention.

DETAILED DESCRIPTION OF PREFERRED EMBODIMENTS

Referring now to the preferred embodiments of the invention shown in the drawings, FIGS. 1-3 show a portable dispensing container for liquid fuels comprising a portable tank 10 having a flexible dispensing nozzle 12 integral therewith and communicating with the tank near one end of the top thereof. A screw-on nozzle cap 13 is preferably also provided. A filler opening 14 is provided near the opposite end of the tank, through which fuel is introduced into the container, and is fitted with a removable cap 20. In order to carry the container conveniently, a handle 22 is provided near the top of the container, and is preferably formed integrally with the rest of the tank; preferably also, another such handle 24 is formed integrally with the tank near the end of the bottom of the tank opposite from the end at which the dispensing nozzle is located. The outlet spout is directed at an upward angle to the horizontal which is substantially equal to the downward angle which the inlet to the gas tank of the care makes with the horizontal.

In use in accordance with the method of the invention, fuel is introduced into the container through the fuel opening 14, and the cap 20 then placed tightly over the opening as by screwing it on. This is preferably done while the bottom of the tank is substantially horizontal, and preferably while it is resting on a horizontal support surface such as the ground. Next the cap 13 is removed and the nozzle end of the container is turned upwardly, by about 90°, with the dispensing nozzle extending at an upward oblique angle so that its tip portion can readily be introduced into the opening of the inlet to the vehicle gas reservoir as shown in FIG. 4. The container is next rotated about an axis extending substantially along the axis of the nozzle, while permitting the nozzle to move inwardly of, and seat itself appropriately in, the fuel inlet 30 of the automobile gas reservoir. If there is no other appropriate venting arrangement, the cap may then be loosened slightly to permit entrance of outside air, whereby the gasoline in the container can rush downwardly and outwardly through the spout into the gas fuel inlet of the fuel reservoir, until the entire container is thereby emptied.

Preferably the spout has some degree of flexibility to aid in placing its tip within the gas intake line upon initial insertion; however, it is self-supporting and operates within its elastic limit; that is, it is not of the gooseneck type whereby it would remain at any angled position in which it is placed, nor is it so limp that it will fall away from its prescribed initial position.

This configuration of container and its method of use permit the container, including its spout and recessed handles, to be made of suitable plastic material in one molding operation, hence inexpensively, so as to be substantially a throw-away item suitable for one-time use. Such a container therefore does away with the problem of providing large deposits for elaborate gas containers at gas stations for use by out-of-gas motorists; the gas station may practically give the container away, or lend it with only a small deposit for its use, or none at all.

FIG. 6 shows another embodiment in which a corrugated section 50 of the nozzle provides additional flexibility, which is helpful when the inlet passageway is especially narrow.

While the invention has been described with particular reference to specific embodiments thereof in the interest of complete definiteness, it will be understood that it may be embodied in a variety of forms diverse from those specifically shown and described, without departing from the spirit and scope of the invention.

What is claimed is:

1. The method of transferring liquid fuel to the downwardly extending fuel inlet line of an automotive vehicle, comprising:

providing a portable dispensing container for liquid fuel, said container having a top and having a fuel inlet aperture at one end of said top, said fuel inlet aperture being provided with a removable closure cap, and said container having an upwardly-extending stiff, tubular dispensing spout at the other end of said top, said spout having a distal end section defining a tubular axis along its longitudinal center line;

with liquid fuel in said container, orienting said container with said closure cap end thereof facing downwardly and said spout extending generally obliquely upwardly;

in this position, introducing said distal end of said spout into the exterior end of said fuel inlet line;

thereafter, turning said container substantially about the tubular axis of said spout, while introducing said spout further into said fuel inlet, until said closure end of said container is positioned upwardly; and while permitting egress of air into the top end of said container, dispensing the liquid fuel through said spout into said fuel inlet line.

2. The method of claim 1, wherein said spout is integrally formed with said container, and is stiff but capable of substantial easy lateral displacement within its elastic limit.

3. A portable container for dispensing engine fuel into the tank of an automotive vehicle, which tank is provided with an inlet passage having a distal end into which fuel is to be dispensed from said container, said passage extending downwardly from said distal end to the interior of said automotive vehicle tank, said portable container comprising:

a portable tank having an elongated integral spout extending therefrom, a carrying handle on said portable tank, and a tilting and holding handle for said portable tank, all of plastic material and integral with each other;

said tank having a top wall in which said carrying handle is integrally molded, having a substantially flat bottom wall suitable for resting said container on a horizontal support surface, and having sidewalls which join said top wall and said bottom wall, said tilting and holding handle being integrally molded in one of said sidewalls and being in said sidewall adjacent to said bottom wall;

said elongated, integral spout extending upwardly and outwardly from the side of said portable tank opposite from said tilting and holding handle;

a filler aperture near the intersection of said top wall and said sidewalls, at the side of said container opposite from said elongated, integral, dispensing spout; and a removable sealing cap for said filler aperture;

wherein said elongated, integral spout is still and self-supporting, has a distal tip, is tapered downwardly in diameter toward said distal tip, and curves upwardly from said tank to terminate in a tubular section, the tubular axis of which extends upwardly at an angle to the horizontal which is substantially the same as the downward angle which said automotive vehicle tank inlet makes with the horizontal.

* * * * *